United States Patent [19]

Villarejos

[11] 4,211,333

[45] Jul. 8, 1980

[54] TAMPERPROOF CONTAINER

[75] Inventor: Miguel Villarejos, Clermont-Ferrand, France

[73] Assignee: Merck & Co., Inc., Rahway, N.J.

[21] Appl. No.: 912,792

[22] Filed: Jun. 5, 1978

[51] Int. Cl.[2] ..... B65D 47/36; B65D 47/38; B65D 41/50

[52] U.S. Cl. ..... 215/249; 215/277; 215/307

[58] Field of Search ..... 215/247, 249, 277, 307, 215/316, 324, 327

[56] References Cited

U.S. PATENT DOCUMENTS

| | | | |
|---|---|---|---|
| 610,715 | 9/1898 | Long | 215/277 |
| 654,533 | 7/1900 | Garner | 215/277 |
| 750,257 | 1/1904 | Chapman | 215/316 |
| 811,824 | 2/1906 | Clay | 215/277 |
| 921,908 | 5/1909 | Stockel | 215/277 |
| 1,105,831 | 8/1914 | Poths | 215/316 |
| 1,375,471 | 4/1921 | Sherman | 215/247 |
| 3,326,401 | 6/1967 | De Long | 215/316 |
| 3,888,377 | 6/1975 | Stadler | 215/249 |
| 4,076,142 | 2/1978 | Naz | 215/260 |

FOREIGN PATENT DOCUMENTS

| | | | |
|---|---|---|---|
| 288752 | 2/1969 | Australia | 215/277 |
| 354119 | 6/1922 | Fed. Rep. of Germany | 215/277 |
| 2326512 | 12/1974 | Fed. Rep. of Germany | 215/307 |
| 612258 | 10/1926 | France | 215/307 |
| 1152373 | 9/1957 | France | 215/307 |
| 118710 | 9/1918 | United Kingdom | 215/277 |

*Primary Examiner*—George T. Hall

*Attorney, Agent, or Firm*—Edmunde D. Riedl; Mario A. Monaco

[57] ABSTRACT

An improved tamperproof container for lyophilized material wherein the container comprises a vial having flange about its opening. Below the flange, but spaced apart therefrom is a shoulder to define an indented neck therebetween. The opening is sealed with a pierceable stopper. An overcap extends over the flange and about the neck to form a skirt about the neck. The skirt has at least a portion thereof extending inwardly in gripping relation with the neck and limited in removal by contact with the underside of the flange whereby the cap cannot be removed without destroying its structural integrity.

1 Claim, 6 Drawing Figures

TAMPERPROOF CONTAINER

DISCLOSURE OF THE INVENTION

This invention relates to an improved tamperproof container for lyophilized material. More particularly, this invention is concerned with vials containing a lyophilized material and having a cap which when fitted in sealing engagement with the opening of the vial can be penetrated by a hollow vial needle to thereby inject a fluid into the vial to reconstitute the lyophilized contents. Most particularly, this invention is concerned with an improved method and closure for positively sealing a vial which method eliminates the need for crimping the overcap about the opening of the vial.

When vaccines or other biologicals are packaged they are often lyophilized to preserve their activity. Lyophilization is essentially a freeze-drying process. Prior to use, the freeze-dried material is reconstituted with sterile water; isotonic solution or other suitable liquid. This liquid is injected into the container of lyophilized material by means of a syringe and needle and after reconstitution the liquid contents are withdrawn in a similar manner for use.

One of the most important aspects of such a container is that it be tamperproof in the sense that if the package were to be opened prior to use that fact would be apparent. In the past, an overcap was crimped about the neck to form a seal. Unfortunately the crimping process sometimes placed inordinate pressure on the vial and often resulted in breakage which necessitated discarding the material; an especially wasteful event since this sealing step is the final step in the manufacturing process.

This crimping operation is now obviated by employing the overcap of this invention which is seated in place by a simple downward pressure on the overcap.

The improved tamperproof container of this invention comprises a vial having a flange about its opening. Below the flange, but spaced apart therefrom is a shoulder to define an indented neck therebetween. The opening is sealed with a pierceable stopper. An overcap extends over the flange and about the neck to form a skirt about the neck. The skirt has at least a portion thereof extending inwardly in gripping relation with the neck and limited in removal by contact with the underside of the flange whereby the cap cannot be removed with destroying its integrity.

The invention can be more clearly understood in greater detail by reference to the accompanying drawing in which FIG. 1 shows a top view of the outercap of this invention;

Figure 1:
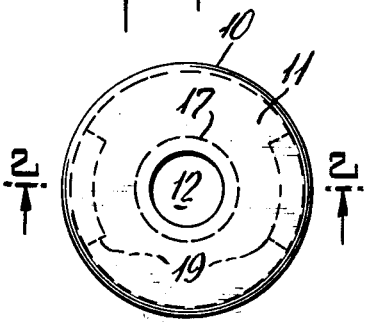
Figure 2:
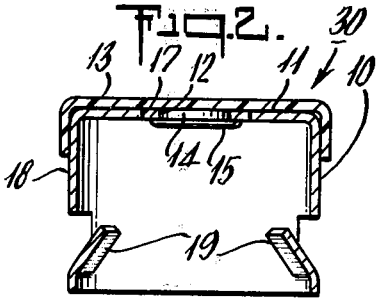
FIG. 2 is a sectional view through 2—2 of FIG. 1.

Referring to the drawing and in particular FIGS. 1 and 2, there is shown outercap 10 having a top portion 11 with an opening 12 therein for passing a syringe needle therethrough. The top portion 11 of the outercap 10 is at least partially covered by removable protective cover 13 having a stem 14 extending into and sealing opening 12. Preferably, terminus 15 of stem 14 is slightly larger than opening 12 so that an overlapping seal results. In the preferred embodiment, there is a nearly perforated portion defined by scores 17 extending about opening 12 so that when cover 13 is removed, the stem 14 remains in the opening 12 and terminum 15 tears off that portion of top portion 11 defined by scores 17. Thus, a positive indication is made when protective cover 13 is removed providing a first safeguard against tampering even through the contents of the vial may still be secure and sterile.

Outercap 10 has downward extending skirts 18 having a plurality of ratchets 19 extending upwardly toward top portion 11 and into the space defined by top portion 11 and skirts 18. Generally, it is preferred that ratchets 19 are attached to the wall of skirt 18 at the lower portions.

Cap 10 and cover 13 can be stamped or molded from any suitable stock material provided the material presents no toxicity hazard to the contents. The preferred material for cap 10 is aluminum, and cover 13 is preferably a thermoplastic material such as polyethylene. These parts can be stamped or molded by any suitable process known to the art. Ratchets 19 can, of course, be cut into skirt 18 and enfolded as part of the stamping operation and such is the preferable procedure.

Figure 3:
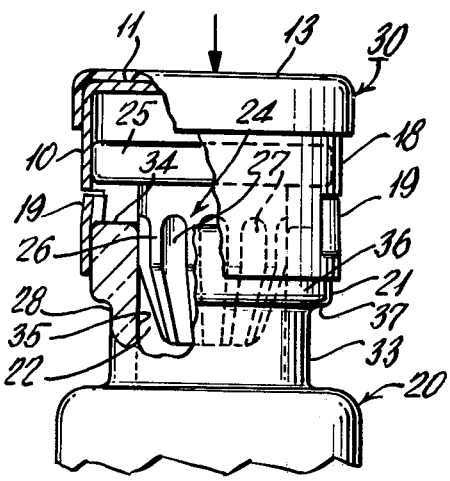
FIG. 3 shows the outercap and seal emplaced on the vial prior to sealing.

Referring now to FIG. 3, cap assembly 30 comprising outercap 10, protective cap 13 and flexible sealing stopper 24 is shown emplaced on vial 20. Sealing stopper 24 comprises capping flange 25 and sealing portion 26. Depending from sealing portion 26 are ribbed members 27 which ribs serve as ventilation passage to provide for the lyophilization of material 23. Ratchets 19 are held outward by vial flange 21. Vial 20 has neck 33 in its uppermost portion which terminates in flange 21 surrounding opening 22 which extends through neck 33 to communicate with the interior of vial 20. In the interior of vial 20 is biological material 23 which at this stage of the process is ready to undergo lyophilization. During lyophilization, capping flange 25 is in spaced apart relation to the upper surface of vial flange 21 so there can be fluid communication by means of ribbed members 27 with the interior of vial 20 and its exterior. Further, the skirt 18 is in non-air tight engagement with flange 21.

Figure 4:
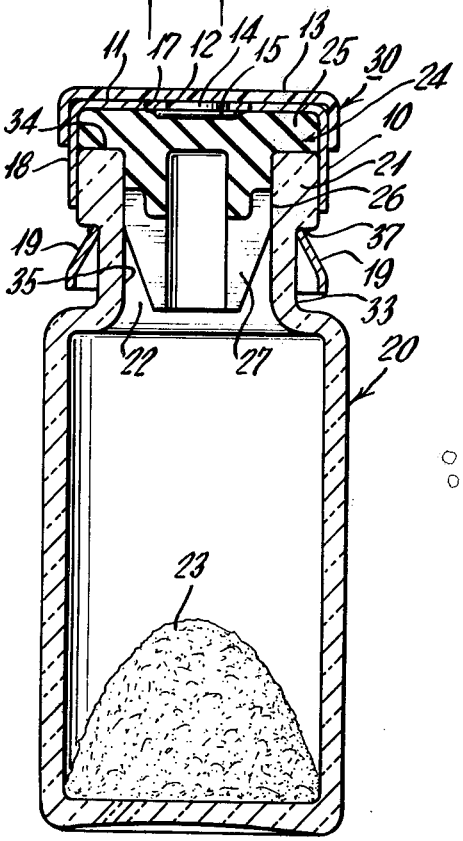
FIG. 4 shows the sealed outercap and seal of FIG. 1.

After the lyophilization procedure is complete, cover assembly 30 is sealed onto vial 20, as shown in FIG. 4. The sealing is accomplished by pressing downwardly on top portion 11 of cap 10 and on protective cover 13 by suitable means so that the top portion 11 of assembly 20 is brought into engagement with capping flange 25, and flange 25 is brought into engagement with vial flange 21. In the sealed position, flange 25 of seal 24 surrounds the upper surface 34 of flange 21 forming a seal about opening 22. The sealing portion 26 extends at least partially into opening 22 in sealing engagement with the inner side 35 of flange 21. Overcap 10 engages flange 21 about its outersides 36. The top portion 11 of overcap 10 sealingly engages capping flange 25. As cap assembly 30 is urged downward, as from the position shown in FIG. 3 to that shown in FIG. 4, ratchets 19 are released from contact with flange 21 and snap inwardly into groove 28 to engage as an upper limit the underside 37 of flange 21. Preferably, there is no play in the cap assembly 30 and the top portion 11 of cap 10 engages capping flange 25 and the end of ratchet 19 engages surface 37.

Figure 5:
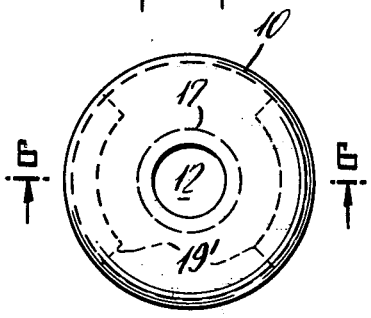
FIG. 5 shows a second embodiment of the outercap.
Figure 6:
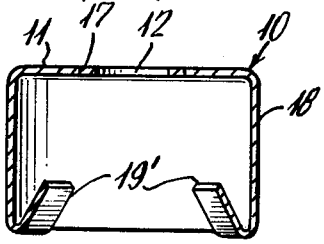
FIG. 6 is a sectional view of the embodiment shown in FIG. 5.

In FIGS. 5 and 6, another embodiment is shown where ratchets 19' extend upwardly from bottom of skirt 18.

Preferably, ratchets 19 and 19' are attached at their lower extremity to skirt 18, and comprise a tab describing an interior angle with the tab and the skirt of less than 90° and preferably less than 60°. The tab is free to move and can spring outwardly to become substantially co-extensive with the skirt and permit passage of the cap assembly over vial flange 25. Thus, it is attached to the skirt only at the bottom and is free to move about its top and sides.

What is claimed is:

1. In an improved tamperproof package for biological material in lyophilized form comprising a container portion and a cap assembly, the container portion having an opening, a neck below the opening, in the neck a flange about the opening and a shoulder spaced apart from the flange to define therebetween a groove; the cap extending over the flange and about the neck to form a skirt, a portion of the skirt extending inwardly in gripping relation to the groove, said skirt having a plurality of ratchets attached to the wall of the skirt and extending upwardly and inwardly from said skirt whereby the overcap is limited in its removal by the flange and can only be removed with the destruction of the structural integrity of the package; the improvement consisting of a sealing stopper in the opening, and the stopper having a capping flange portion and a stem portion; the capping flange portion sealingly engaged with the flange of the container; the stopper having in the stem portion ventilation ribs so that when the capping flange is in spaced apart relation from the container flange, the ventilation ribs allowing fluid communication between the interior of the container and the exterior; the sealed portion of the skirt extending inwardly to engage the juncture of the groove and the container flange; the top of the cap engaging the capping flange in sealing relation; and a sealable opening in the cap for introducing a syringe needle therethrough to introduce reconstituting liquid and for withdrawing the biological material after reconstitution.

* * * * *